US011001982B2

(12) United States Patent
Burr

(10) Patent No.: US 11,001,982 B2
(45) Date of Patent: May 11, 2021

(54) MANHOLE COVER ASSEMBLY

(71) Applicant: NEENAH FOUNDRY COMPANY, Neenah, WI (US)

(72) Inventor: Randy Burr, Neenah, WI (US)

(73) Assignee: Neenah Foundry Company, Neenah, WI (US)

( * ) Notice: Subject to any disclaimer, the term of this patent is extended or adjusted under 35 U.S.C. 154(b) by 87 days.

(21) Appl. No.: 15/835,589

(22) Filed: Dec. 8, 2017

(65) Prior Publication Data

US 2018/0100286 A1 Apr. 12, 2018

Related U.S. Application Data

(62) Division of application No. 15/268,015, filed on Sep. 16, 2016, now Pat. No. 9,909,275.

(Continued)

(51) Int. Cl.
*E02D 29/14* (2006.01)

(52) U.S. Cl.
CPC ..... *E02D 29/1427* (2013.01)

(58) Field of Classification Search
CPC ..... Y10T 292/1043; Y10T 292/1051; Y10T 292/1053; Y10T 292/1054; Y10T 292/1059; Y10T 292/106; Y10T 292/1062; Y10T 292/1071; Y10T 292/1077; Y10T 292/108; Y10T 70/554; Y10T 70/5544;

(Continued)

(56) References Cited

U.S. PATENT DOCUMENTS 599,441 A 2/1898 Dorr
737,667 A * 9/1903 Schunck (Continued)

FOREIGN PATENT DOCUMENTS

DE 28 26 082 6/1978
EP 0305245 A1 * 3/1989 ..... E02D 29/1427

(Continued)

OTHER PUBLICATIONS

Non-Final Office Action on U.S. Appl. No. 16/284,765 dated Jul. 10, 2019.

(Continued)

*Primary Examiner* — Thomas B Will
*Assistant Examiner* — Katherine J Chu
(74) *Attorney, Agent, or Firm* — Foley & Lardner LLP

(57) ABSTRACT

A manhole cover assembly includes a manhole cover supportable by a manhole frame. The manhole cover defines a latch bore having a longitudinal axis. A latch housing extends from the manhole cover, and a latch assembly is positioned at least partially therein. A first end of a latch yoke extends through the latch bore and slidably couples the latch yoke to the manhole cover along the longitudinal axis. A latch member is rotatably coupled to the second end of the latch yoke about a first transverse axis perpendicular to the longitudinal axis. The latch member is also rotatably coupled to the latch housing about a second transverse axis spaced from the first transverse axis. The latch member is selectively rotatable relative to the latch housing about the second transverse axis, between a locked position and an unlocked position, via sliding the latch yoke relative to the manhole cover.

20 Claims, 7 Drawing Sheets

Related U.S. Application Data

(60) Provisional application No. 62/219,907, filed on Sep. 17, 2015.

(58) Field of Classification Search
CPC ..... Y10T 70/5549; Y10T 70/5558; Y10T 292/1052; Y10T 292/1056; Y10S 292/11; Y10S 70/34; E05B 65/006; B65D 90/10; E02D 29/1427; E02D 29/14; E02D 29/1418; E02D 29/1436
USPC ..... 404/25, 26
See application file for complete search history.

(56) References Cited

U.S. PATENT DOCUMENTS 897,048 A 8/1908 Astfalck
969,881 A * 9/1910 Klemm
1,076,386 A 10/1913 O'Day
1,458,391 A * 6/1923 Burton ..... F16J 13/08 137/371
1,616,298 A * 2/1927 Arnett ..... E05B 65/006 70/168
1,902,731 A 3/1933 Sherman
2,113,747 A * 4/1938 Roedding ..... E05B 63/244 292/127
2,436,016 A * 2/1948 Myers ..... F16J 13/08 220/248
2,466,993 A * 4/1949 Lickteig ..... E05C 3/162 292/78
2,927,812 A * 3/1960 Smith ..... E05C 3/122 292/196
2,987,908 A 6/1961 Pelcin
3,182,581 A * 5/1965 Von Poederoyen ..... F24F 7/02 52/1
3,530,696 A * 9/1970 Dunmire ..... E05B 65/006 70/167
3,729,771 A 5/1973 Crane et al.
3,871,198 A 3/1975 Miller
3,970,343 A 7/1976 Horn
4,145,259 A 3/1979 Leumann
4,337,005 A 6/1982 Lebaron
4,461,597 A * 7/1984 Laurin ..... E02D 29/1427 137/371
4,739,896 A * 4/1988 Moss ..... E02D 29/1427 220/324
4,750,569 A * 6/1988 Flogaus ..... E05C 9/025 174/375
4,906,128 A 3/1990 Trudel
4,925,221 A * 5/1990 Carmody ..... E05C 3/08 292/196
4,928,615 A * 5/1990 Williams ..... E05C 9/06 114/201 R
5,211,504 A 5/1993 Trudel
5,344,253 A 9/1994 Sacchetti
5,451,119 A 9/1995 Hondulas
5,465,862 A * 11/1995 Devlin ..... B64F 1/362 16/278
5,525,006 A 6/1996 Kilman et al.
5,533,641 A * 7/1996 Argandona ..... B65D 90/105 220/248
5,788,406 A 8/1998 Hernandez
5,950,368 A * 9/1999 Bradford ..... E02D 29/1418 220/484
6,125,508 A * 10/2000 Formenti ..... E05D 5/08 16/278
6,199,414 B1 * 3/2001 Chang ..... E02D 29/1427 292/11
6,266,928 B1 7/2001 Argandona
6,311,433 B1 11/2001 Zdroik
6,616,370 B1 * 9/2003 Signorelli ..... B65D 90/48 404/25
6,763,967 B2 * 7/2004 Calder ..... F16L 55/11 220/323
6,764,261 B1 * 7/2004 Stadler ..... E02D 29/1427 411/340
6,811,119 B1 11/2004 Petersen et al.
6,851,225 B1 2/2005 Haar et al.
6,913,297 B2 * 7/2005 Jackson ..... E05B 1/0092 292/195
6,951,318 B1 * 10/2005 Petersen ..... E02D 29/1427 220/315
7,128,495 B1 * 10/2006 Lill ..... E01C 11/223 404/4
7,223,051 B1 5/2007 Vought et al.
7,243,515 B2 * 7/2007 Meyer ..... E02D 29/1427 404/25
7,484,908 B2 * 2/2009 Stadler ..... E02D 29/1418 404/25
7,704,010 B2 4/2010 Nolle et al.
7,712,995 B2 * 5/2010 Stadler ..... E02D 29/1436 404/25
7,798,742 B2 9/2010 Nolle et al.
7,887,252 B1 2/2011 Wang
7,891,904 B2 * 2/2011 Stadler ..... E02D 29/1436 404/25
7,896,574 B2 3/2011 Nolle et al.
8,220,298 B2 7/2012 Burke et al.
8,449,216 B2 5/2013 Vrondran et al.
8,674,830 B2 3/2014 Lanham et al.
8,784,000 B2 * 7/2014 Reynolds ..... E02D 29/1436 404/25
8,888,400 B2 11/2014 Nolle et al.
9,127,431 B2 9/2015 Lanham et al.
9,157,212 B2 10/2015 Nolle et al.
9,340,948 B2 5/2016 Allen et al.
9,416,516 B2 8/2016 Stadler
9,771,702 B2 9/2017 Han
9,909,275 B2 * 3/2018 Burr ..... E02D 29/1427
9,915,052 B2 3/2018 Shokouhi
2005/0285412 A1 12/2005 Kim
2006/0255596 A1 11/2006 Yong
2009/0255183 A1 * 10/2009 Nolle ..... E02D 29/14 49/57
2010/0193293 A1 8/2010 Murray et al.
2010/0281778 A1 11/2010 Loya-Morales
2011/0025074 A1 2/2011 Reznar
2011/0222964 A1 9/2011 Lacroix
2012/0020728 A1 1/2012 Royer et al.
2013/0195549 A1 8/2013 Fier
2013/0221688 A1 * 8/2013 Stadler ..... E02D 29/1427 292/155
2014/0250794 A1 9/2014 Reynolds et al.
2015/0076835 A1 * 3/2015 Mitchell ..... E05B 77/38 292/194
2015/0104254 A1 4/2015 Minarovic
2016/0097181 A1 4/2016 Allen et al.
2016/0289912 A1 10/2016 Smith
2016/0289913 A1 * 10/2016 Canney ..... E05B 35/008
2017/0081821 A1 * 3/2017 Shokouhi ..... E02D 29/1427

FOREIGN PATENT DOCUMENTS

EP 0 737 782 10/1996
EP 0737782 A1 * 10/1996 ..... E02D 29/1427
EP 0 856 611 A1 8/1998
EP 1 526 236 1/2008
EP 2 987 915 A1 2/2016
FR 2685716 7/1993
JP 2000-120096 A 4/2000
JP 2004-011247 A 1/2004
JP 2005-290731 A 10/2005
JP 2007-224687 A 9/2007
JP 2008-038542 2/2008
KR 101156757 3/2011
WO WO-2015/006559 A1 1/2015

OTHER PUBLICATIONS

Search Report from corresponding UK Application No. GB1615657.2, dated Feb. 20, 2017, pp. 1-2.

(56) References Cited

OTHER PUBLICATIONS

Search Report issued in Great Britain application No. GB1615654.9, dated Dec. 15, 2016.
U.S. Office Action on U.S. Appl. No. 15/267,903 dated Apr. 6, 2017.
U.S. Office Action on U.S. Appl. No. 15/491,541 dated Jan. 26, 2018.
Final Office Action for U.S. Appl. No. 15/874,584, dated Jul. 14, 2020.
Non-Final Office Action for U.S. Appl. No. 15/874,584 dated Jan. 13, 2020.

* cited by examiner

150

MANHOLE COVER ASSEMBLY

CROSS REFERENCE TO RELATED APPLICATIONS

The present application is a divisional of U.S. patent application Ser. No. 15/268,015, filed Sep. 16, 2016, which claims the benefit of priority to 62/219,907, filed Sep. 17, 2015, the contents of which are incorporated herein by reference in their entirety.

TECHNICAL FIELD

The present disclosure relates generally to the field of manhole and hatch cover assemblies.

BACKGROUND

A manhole provides access to an underground passage or confined area. The underground passage or confined area may contain public utility equipment, such as sewer lines, storm drains, electrical and telecommunication cables, etc. A manhole or hatch cover is a removable plate that forms a lid over the opening of a manhole. Manhole covers are used to prevent individuals and objects from falling into the manhole, as well as to prevent unauthorized access into the manhole. The terms "manhole cover" as used herein to mean either a manhole cover, or a hatch cover and the like.

Manhole covers are conventionally formed of cast iron, which makes them inexpensive, strong, and heavy, usually weighing more than 100 pounds. The weight helps to keep them in place when traffic passes over them, and makes it difficult for unauthorized individuals to remove them. In addition to being constructed of cast iron, manhole covers may also be constructed of concrete, glass-reinforced plastic or other composite materials, and other materials, or any combination thereof.

Despite their significant weight, manhole covers can be dislodged in several ways. For example, an explosion within a manhole can cause a sudden pressure buildup that can dislodge the manhole cover. For example, gases (e.g., methane from sewage or natural gas from a leaking natural gas line) can become trapped in the space within the manhole, as well as within the passages or spaces connected to the manhole. The gas may be ignited, for example, due to a spark from a frayed power cable. Some explosions generate sufficient pressure to dislodge the manhole from its frame. However, higher-intensity explosions may propel the manhole cover up to 20 feet or more into the air. A heavy manhole cover flying through the air can be extremely dangerous or deadly. In addition to the human and property damage risk, individuals or objects may subsequently fall into the now-uncovered manhole.

Excessive rainfall and flooding can also dislodge manhole covers. For example, storm drain systems may become overfilled during periods of excessive rainfall. Water may flow through the storm drain systems and up through a manhole. Sufficient pressure from the water may dislodge manhole covers and "float" them away. The now-uncovered manhole can be obscured by dirty water, thereby providing a dangerous risk that an unwary victim may inadvertently fall into the manhole and into the storm drain system.

SUMMARY

Various embodiments relate to manhole cover assemblies. An example manhole cover assembly includes a manhole cover supportable by a manhole frame. The manhole cover defines a latch bore having a longitudinal axis. A latch housing extends from a face of the manhole cover, and is positioned at least partially within the latch housing. A latch yoke has first end and an opposite second end. The first end extends through the latch bore and slidably couples the latch yoke to the manhole cover along the longitudinal axis. A latch member is rotatably coupled to the second end about a first transverse axis perpendicular to the longitudinal axis. The latch member is also rotatably coupled to the latch housing about a second transverse axis parallel to and spaced from the first transverse axis. The latch member is selectively rotatable relative to the latch housing about the second transverse axis, between a locked position and an unlocked position, via sliding the latch yoke relative to the manhole cover.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below, Other features, aspects, and advantages of the disclosure will become apparent from the description, the drawings, and the claims.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Various events, such as explosions or flooding, can cause a sudden pressure increase beneath a manhole cover, which can force the manhole cover from its frame. Several manhole cover assemblies have been developed to release pressure buildup from beneath a manhole cover while limiting displacement of the manhole cover relative to its frame. For example, some manhole cover assemblies include legs or other features to permit limited displacement of the manhole cover. During a pressure-inducing event, the legs contact a bottom surface of the frame, thereby limiting travel of the manhole cover. However, the kinetic energy of the rising manhole cover is concentrated into relatively small areas of the frame surface that are contacted by the legs. Accordingly, significant pressure-inducing events, such as explosions or floods, may damage the frame. This is undesirable because the frame is typically cemented or otherwise permanently fixed in a street or roadway, and removal and replacement of the frame is a significant and costly undertaking.

In addition, manhole covers must be removed from time to time to access the space between the manhole (e.g., a utility vault) to perform inspections, maintenance, repairs, etc. However, manhole covers are also an attractive target for vandals and scavengers due to their relatively substantial value as scrap metal, as well as the value of items housed beneath the manhole cover (e.g., copper wire and other valuable equipment).

Figure 1:
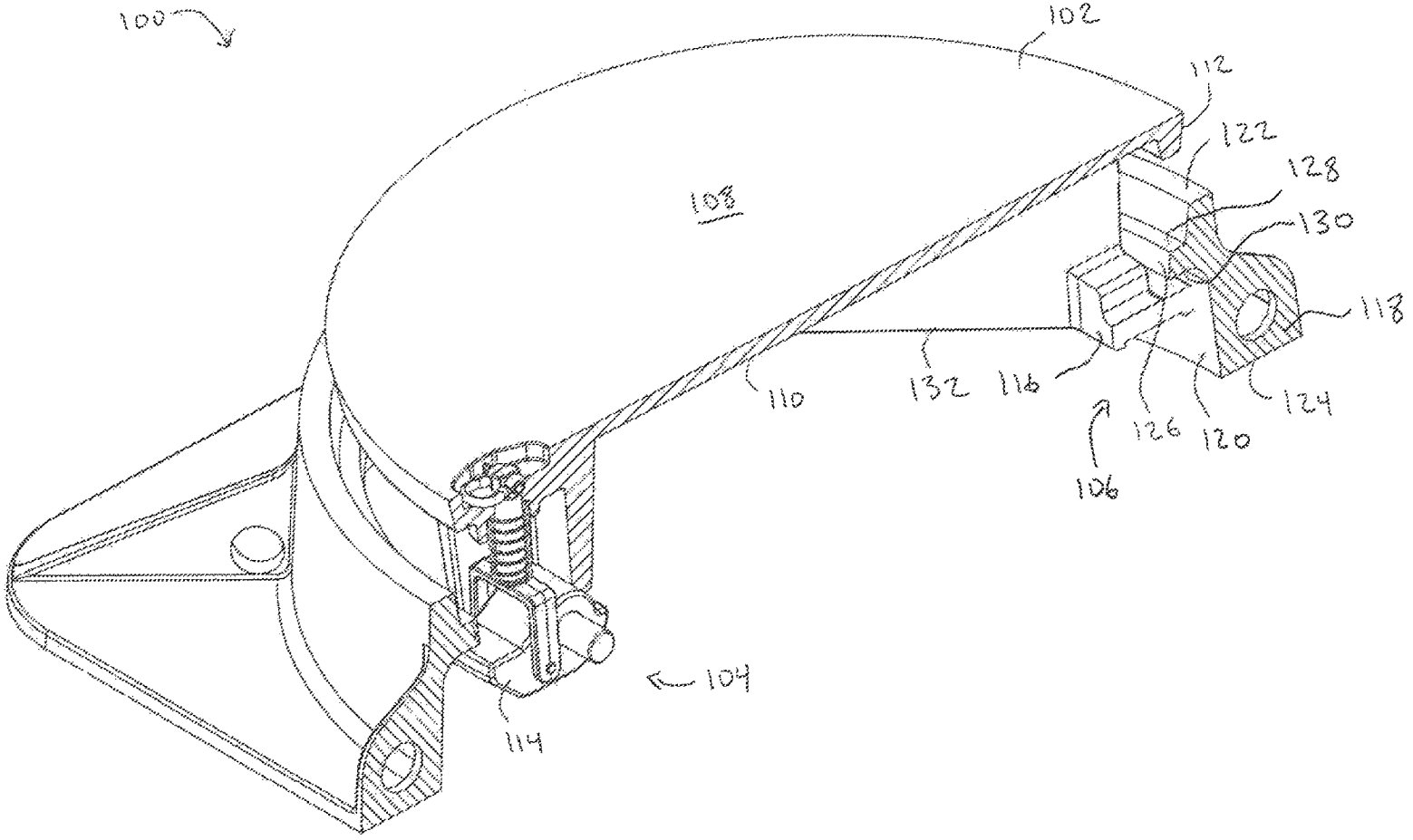
FIG. 1 is a cross-sectional perspective view of a manhole cover assembly, according to an embodiment.

FIG. 1 is a cross-sectional perspective view of a manhole cover assembly 100, according to an embodiment. It should be noted that for clarity and brevity, embodiments are described herein as relating to manhole cover assemblies. However, embodiments described herein may also be utilized in conjunction with hatch covers or other types of covers. As shown in FIG. 1 the manhole cover assembly 100 includes a manhole cover 102, a latch assembly 104, and a lug assembly 106. The manhole cover 102 is generally disc-shaped, having a top surface 108, a bottom surface 110 and an outer periphery 112. The latch assembly 104 and the lug assembly 106 are each securely coupled (e.g., bolted, welded, etc.) to the bottom surface 110 of the manhole cover 102. The latch assembly 104 includes a latch 114 extending radially outward from the latch assembly 104. Similarly, the lug assembly 106 includes a lug 116 extending radially outward from the lug assembly 106.

A frame 118 is configured to support the manhole cover 102 over the opening of a manhole (not shown). The frame 118 is fixedly secured (e.g., cemented or otherwise fixed) within a substrate (e.g., street, road, sidewalk, etc.) defining the opening of the manhole (not shown). The frame 118 is generally ring-shaped, having a peripheral wall 120 extending between an upper surface 122 and an opposite lower surface 124. The peripheral wall 120 has an inner diameter that is slightly larger than an outer diameter of the manhole cover 102. In operation, the upper surface 122 of the frame 118 is generally flush with the road or other surface that defines the manhole.

Figure 4:
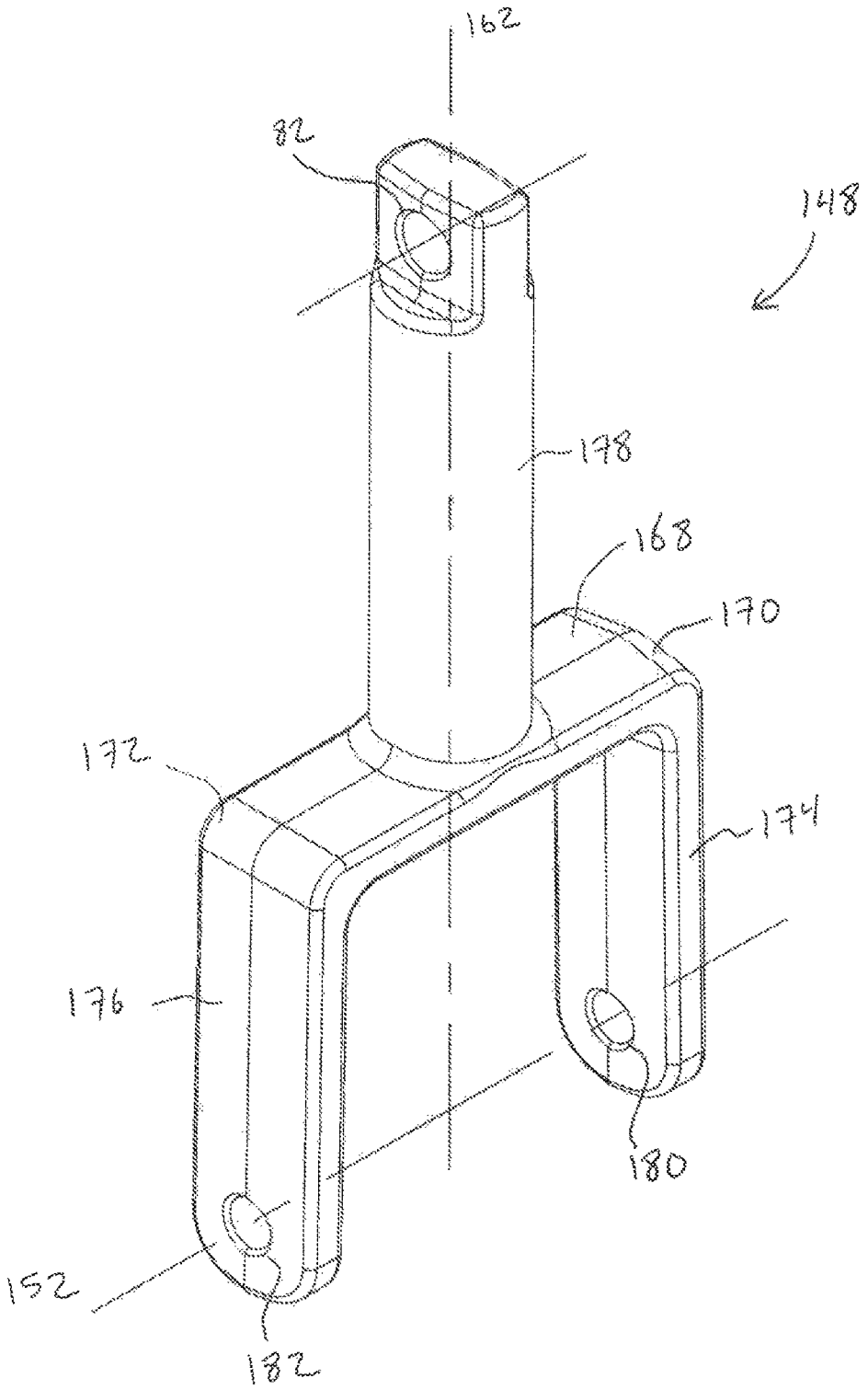
FIG. 4 is a top perspective view of the latch yoke of FIG. 3.

The frame 118 also includes a projection 126 that extends radially inward from the peripheral wall 120. The projection 126 defines a seat 128 facing longitudinally outward toward the upper surface 122, and defines a catch 130 facing longitudinally inward toward the lower surface 124. The seat 128 is structured to support the manhole cover 102 within the frame 118. More specifically, the bottom surface 110 of the manhole cover 102 proximate the outer periphery 112 rests on, and is supported by, the seat 128 when the manhole cover is in a seated position (FIG. 4). The top surface 108 of the manhole cover 102 is generally flush with the upper surface 122 of the frame 118 when the manhole cover 102 is in the seated position. The catch 130 is structured to be engaged by the each of the latch 114 and the lug 116 during a pressure-inducing event so as to retain the manhole cover 102, while controllably dissipating pressure from within the manhole.

Figure 2:
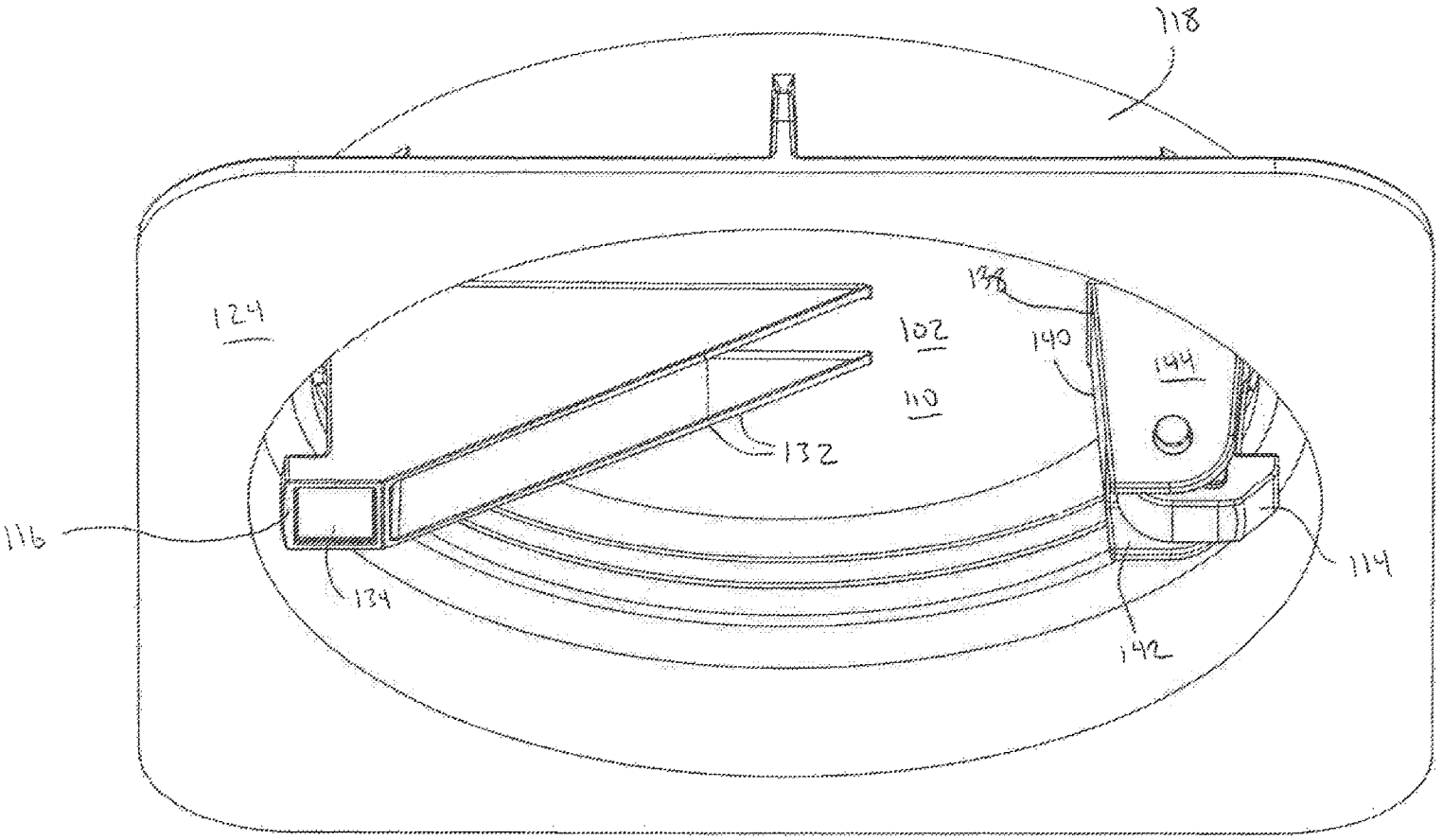
FIG. 2 is a bottom perspective view of the manhole cover assembly of FIG. 1, with the manhole cover in the seated position.

FIG. 2 is a bottom perspective view of the manhole cover assembly 100 of FIG. 1, with the manhole cover 102 in the seated position. As shown in FIG. 2, when the manhole cover 102 is in the seated position, as is typically the case, there is a gap between the catch 130 and each of the latch 114 and the lug 116. A sudden pressure increase against the bottom surface 110 of the manhole cover 102 can cause the manhole cover 102 to move relative to the frame 118 from the seated position (e.g., as shown in FIG. 2) to the unseated position (e.g., as shown in FIG. 1). Returning to FIG. 1, it can be seen that in the unseated position, the latch 114 and the lug 116 each contact the catch 130. Accordingly, the latch and lug assemblies 104, 106 are configured to limit displacement of the manhole cover 102 during a pressure-inducing event in which the manhole cover 102 is forced to the unseated position.

The latch and lug assemblies 104, 106 are also configured to controllably dissipate pressure from within the manhole during a pressure-inducing event. As discussed in further detail below, the latch and lug assemblies 104, 106 permit the energy from a pressure-inducing event (e.g., an explosion or flood) to move the manhole cover 102 from the seated position to the unseated position. When in the unseated position, high-pressure fluid (e.g., air or water) and debris may escape from the manhole through the space then available between the manhole cover 102 and the frame 118, proximate the outer periphery 112 of the manhole cover 102 and the projection 126 of the frame 118. Thus, in response to a pressure-inducing event, the latch and lug assemblies 104, 106 of the manhole cover assembly 100 operate to controllably release pressure from within a manhole rather than allowing the pressure to build up beneath the manhole cover 102 to a potentially dangerous level. In doing so, the latch and lug assemblies 104, 106 prevent the manhole cover 102 from being launched from the frame 118 by a pressure-inducing event, while also preventing damage to the frame 118 and the surface (e.g., street) to which the frame is secured.

Figure 3:
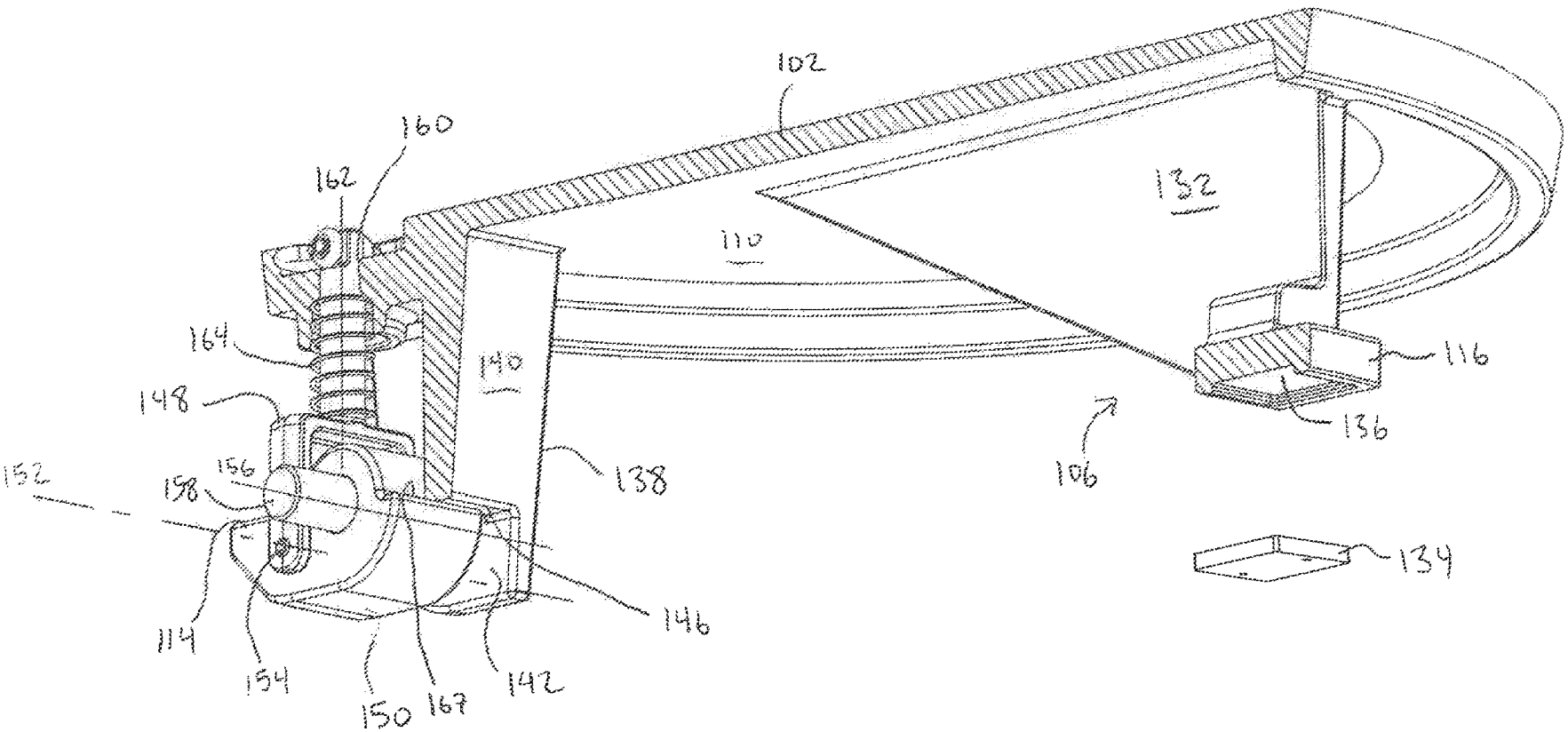
FIG. 3 another cross-sectional perspective view of the manhole cover assembly of FIGS. 1 and 2.

The manhole cover assembly 100 also includes extractor rails 132 fixedly coupled (e.g., welded) to each of the manhole cover 102 and the lug assembly 106 so as to form a gradual ramp from the lug 116 to the bottom surface 110 of the manhole cover 102. The extractor rails 132 facilitate easy removal of the manhole cover 102 from the frame 118. In particular, as the manhole cover 102 is pulled away from the frame 118, extractor rails 132 slide against the upper surface 122 of the peripheral wall 120 of the frame 118, FIG. 3 is another cross-sectional perspective view of the manhole cover assembly 100 of FIGS. 1 and 2. As illustrated in FIG. 3, the lug assembly 106 may further include a skid pad 134 affixed (e.g., bolted) to a bottom surface 136 of the lug 116. The skid pad 134 is configured to support the manhole cover 102 against a surface (e.g., a roadway) upon the manhole cover 102 being removed from the frame 118. According to various embodiments, the skid pad 134 may be formed of high molecular weight polyethylene (HMWP), Teflon, rubber, or other materials.

As further illustrated in FIG. 3, the manhole cover 102 defines a latch housing 138 that extends from the bottom surface 110 of the manhole cover 102. In one embodiment, as shown in FIGS. 2 and 3, the latch housing 138 includes an inner wall 140, a first lateral wall 142 (FIG. 3), and a second lateral wall 144 (FIG. 2), which together form the latch housing 138. The first and second lateral walls 142, 144 extend further from the bottom surface 110 than the inner wall 140. The distal surface of the inner wall 140 defines a catch 146. In one embodiment, the inner wall 140 and the first and second lateral walls 142, 144 are formed of metal (e.g., steel, iron, aluminum, any alloys thereof, etc.) plates or sheet metal, which are welded together to form the latch housing 138. In other embodiments, the inner wall 140 and the first and second lateral walls 142, 144 are formed of cast metal (e.g., steel, iron, aluminum, any alloys thereof, etc.), stamped sheet metal (e.g., steel or aluminum), and injection molded polymer to form the latch housing 138.

The latch assembly 104 includes a latch yoke 148 positioned at least partially within the latch housing 138. A latch member 150 is rotatably coupled to latch yoke 148 relative to a first transverse axis 152 via a yoke pin 154. The latch member 150 is also rotatably coupled to the latch housing 138 relative to a second transverse axis 156 via a pivot pin 158. The second transverse axis 156 is spaced from the first transverse axis 152. The latch yoke 148 extends through a latch bore 160 defined by the manhole cover 102 along a longitudinal axis 162. The latch yoke 148 is slidably coupled to the manhole cover 102 along the longitudinal axis 162 via the latch bore 160. A latch spring 164 is positioned within the latch housing 138 coaxial to the longitudinal axis 162. When assembled, the latch spring 164 is compressed between the latch yoke 148 and the bottom surface 110 of the manhole cover 102. A clevis 166 is coupled to the latch yoke 148 opposite the latch member 150 at a portion of the latch yoke 148 extending through the latch bore 160 so as to retain the latch yoke 148 with the manhole cover 102. In other embodiments, a lift ring or other fastener is utilized instead of the clevis 166.

The latch member 150 is selectively rotatable relative to the latch housing 138 about the second transverse axis 156, between a locked position and an unlocked position, via raising or lowering the latch yoke 148 relative to the manhole cover. The latch member 150 defines the latch 114, and also defines a stop 167 opposite the latch 114. Each of the latch 114 and the stop 167 define planar surfaces structured to engage an obstacle so as to restrict movement of the latch member 150. In the locked position, the latch 114 extends radially outward relative to the manhole cover 102. In the unlocked position, the latch 114 extends radially upward relative to the manhole cover 102.

FIG. 4 is a top perspective view of the latch yoke 148 of FIG. 3. The latch yoke 148 includes a yoke base 168 having first and second ends 170, 172, First and second yoke arms 174, 176 extend perpendicular to the yoke base 168 from the respective first and second ends 170, 172 of the yoke base 168. A yoke shaft 178 extends along the longitudinal axis 162 (FIG. 3) perpendicular to the yoke base 168 opposite the first and second ends 174, 176. The yoke shaft 178 is centered between the first and second ends 174, 176 of the yoke base 168. The first and second yolk arms 174, 176 define respective first and second yoke pin bores 154. The first and second yoke pin bores 154 are coaxial to the first transverse axis 152 (FIG. 3), and are structured to receive the yoke pin 154 (FIG. 3). The yoke shaft 178 defines a clevis bore 182 opposite the yoke base 168, and extending along a third transverse axis 184, which may be parallel to the first and second transverse axes 152, 156. The clevis bore 182 is structured to receive the clevis 166 or lift ring, which is used to raise the latch 114 to the unlocked position.

Figure 5:
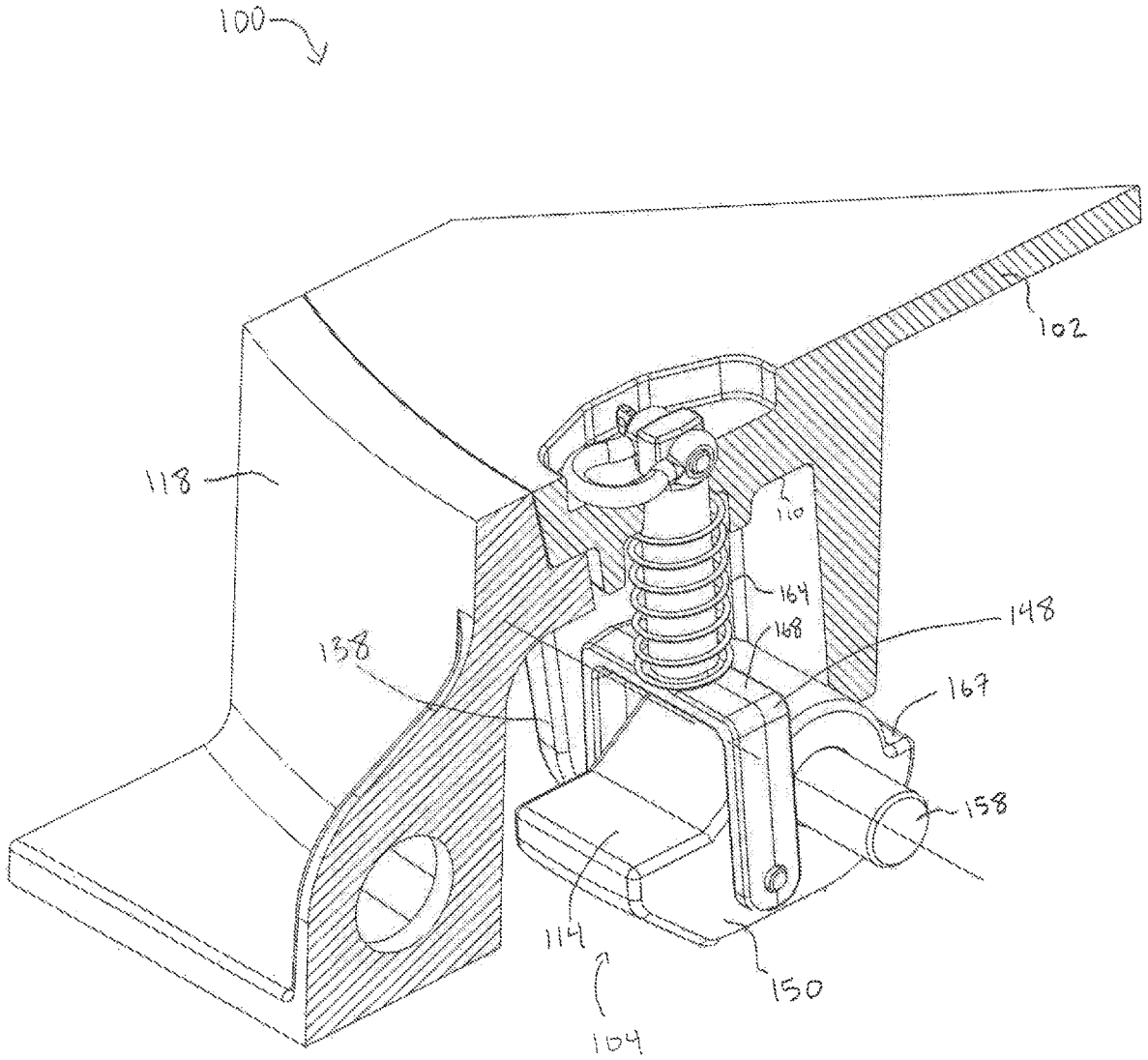
FIG. 5 is a partial cross-sectional perspective view of the manhole cover assembly of FIGS. 1-3, with the manhole cover in the seated position against the frame, and the latch assembly in the locked position.

FIG. 5 is a partial cross-sectional perspective view of the manhole cover assembly 100 of FIGS. 1-3, with the manhole cover 102 in the seated position against the frame 118, and the latch assembly 104 in the locked position. Specifically, the latch assembly 104 is in the locked position because the yoke 148 is hilly extended relative to the manhole cover 102. FIG. 5 illustrates the typical configuration of a manhole cover assembly 100 in operation. In this configuration, the latch spring 164 is compressed between the bottom surface 110 of the manhole cover 102 and the yoke 148, specifically the yoke base 168 of the yoke 148. Because the pivot pin 158 is translationally fixed relative to the latch housing 138, the force from the latch spring 164 attempts to rotate the latch member 150 so as to rotate the latch 114 of the latch member 150 downwards. The stop 167 of the latch member 150 engages the catch 146 defined by the inner wall 140 of the latch housing 138 so as to restrict further rotation of the latch member 150. Accordingly, the latch assembly 104 retains the latch member 150 in the locked position while the yoke 148 is fully extended relative to the manhole cover 102.

Returning briefly to FIG. 1, the latch assembly 104 is shown in the locked position with the manhole cover 102 in an unseated position relative to the frame 118, for example, in response to a pressure-inducing event. As shown in FIG. 1, the latch 114 of the latch assembly 104 engages the catch 130 of the frame 118, in conjunction with the lug 116, so as to prevent the manhole cover 102 from being launched from the frame 118, It should be noted that the latch assembly 104 is structured such that pressure-inducing events do not force the yoke 148 of the latch assembly 104 upwards faster than the manhole cover 102 is forced upwards relative to the frame 118. Accordingly, pressure-inducing events do not operate to unlock the latch assembly 104.

Figure 6:
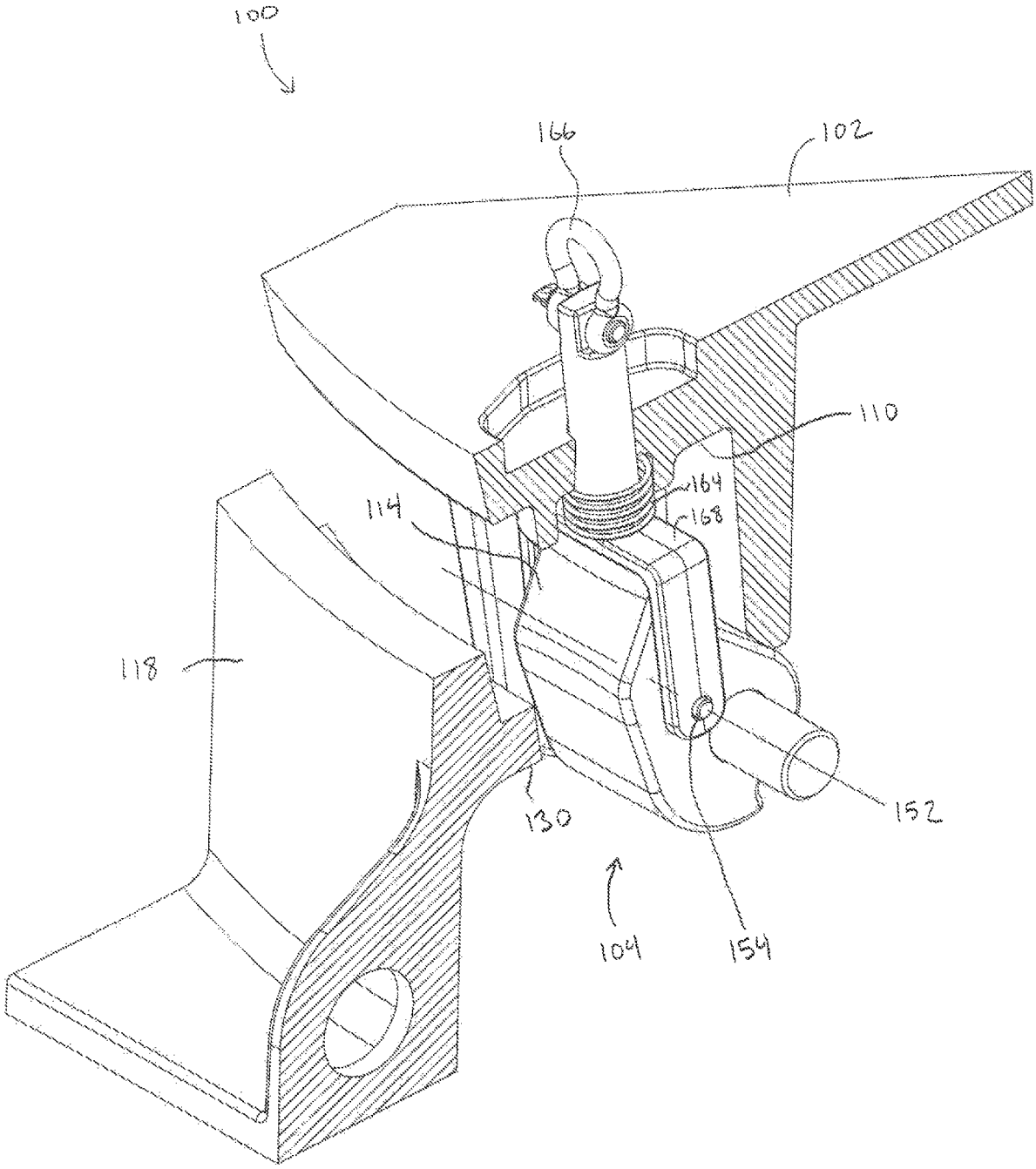
FIG. 6 is a partial cross-sectional perspective view of the manhole cover assembly of FIGS. 1-3 and 5 showing the latch assembly in the unlocked position and the manhole cover displaced from the frame.

FIG. 6 is a partial cross-sectional perspective view of the manhole cover assembly 100 of FIGS. 1-3 and 5 showing the latch assembly 104 in the unlocked position and the manhole cover 102 displaced from the frame 118. When it is the intention to remove the manhole cover 102 for service or inspection, the clevis 166 or lift ring is raised with a lifting hook (not shown), thereby raising the latch yoke 148 relative to the manhole cover 102 and compressing the latch spring 164. The yoke pin 154 in turn lifts and rotates the latch 114 relative to the first transverse axis 152, thereby raising the latch 114 to a position sufficient to allow the latch 114 to clear the catch 130 of the frame 118, Upon releasing the clevis 166, the latch spring 164 applies pressure between the bottom surface 110 of the manhole cover 102 and the yoke base 168 of the latch yoke 148, thereby inducing the latch yoke 148 and the latch 114 to return to the closed and locked position. When the manhole cover 102 is being placed back into the frame 118, the latch 114 contacts the seat 128 of the frame 118, thereby rotating the latch 114 upwards and compressing the latch spring 164 so as to enable the latch 114 to pass by the seat 128 and catch 130, and allow the manhole cover 102 to return to the normal seated position resting against the seat 128. Upon clearing the catch 130, the latch spring 164 extends to its normal position, maintaining the latch assembly 104 in the closed and locked position.

In order to remove the manhole cover 102 from the frame 118, the latch assembly 104 is first unlocked as described above. The manhole cover 102 is pulled away from the frame 118, and extractor rails 132 (FIG. 1) formed on the bottom surface 110 of the manhole cover 102 slide against the upper surface 122 of the peripheral wall 120 of the frame 118 As the manhole cover 102 is completely removed from the frame 118, the manhole cover 102 is supported on the skid pad 134 against the outer surface (e.g., roadway).

Figure 7:
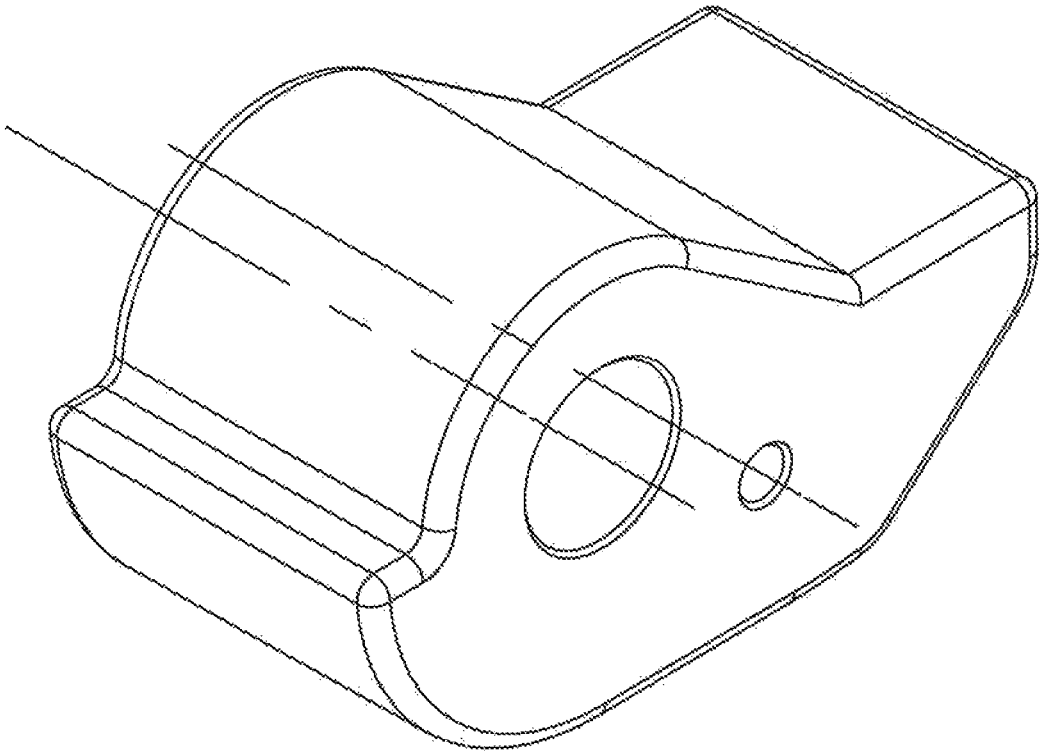
FIG. 7 is a perspective view of the latch member of the manhole cover assembly of FIGS. 1-3 and 5-6.

FIG. 7 is a perspective view of the latch member 150 of the manhole cover assembly 100 of FIGS. 1-3 and 5-6.

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and any similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided unless otherwise noted. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled" and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. When the language "at least a portion" and/or "a portion" is used the item can include a portion and/or the entire item unless specifically stated to the contrary.

What is claimed is:

1. A latch assembly for a manhole cover, comprising:

a latch yoke, comprising:

a yoke shaft extending along a longitudinal axis, the yoke shaft configured to be slidingly received through a latch bore of a manhole cover;

a yoke base extending laterally away from and coupled to an end of the yoke shaft, the yoke base having a first base end; and a first yoke arm extending perpendicularly from and rigidly coupled to the first base end, the first yoke arm having a first yoke pin bore defining a first transverse axis perpendicular to the longitudinal axis;

a latch member rotatably coupled to the latch yoke about the first transverse axis, the latch member defining a latch configured to engage a catch of a manhole frame; and a latch housing extending from the manhole cover, the latch member rotatably coupled to the latch housing about a second transverse axis parallel to the first transverse axis.

2. The latch assembly of claim 1, wherein the latch member defines a stop opposite the latch, the stop configured to restrict rotation of the latch member.

3. The latch assembly of claim 2, wherein the stop is configured to engage a catch defined by an inner wall of the latch housing.

4. The latch assembly of claim 3, wherein the latch housing further comprises first and second lateral walls, and wherein the latch member is coupled to the latch housing at the first and second lateral walls.

5. The latch assembly of claim 4, wherein the first and second lateral walls extend further from the manhole cover than the inner wall, such that the catch is defined at a distal end of the inner wall between the first and second lateral walls.

6. A latch assembly for a manhole cover, comprising:

a latch yoke, comprising:

a yoke shaft extending along a longitudinal axis, the yoke shaft configured to be slidingly received through a latch bore of a manhole cover;

a yoke base extending laterally away from and coupled to an end of the yoke shaft, the yoke base having a first base end; and a first yoke arm extending perpendicularly from and rigidly coupled to the first base end, the first yoke arm having a first yoke pin bore defining a first transverse axis perpendicular to the longitudinal axis; and a latch member rotatably coupled to the latch yoke about the first transverse axis, the latch member defining a latch configured to engage a catch of a manhole frame;

a latch housing extending from the manhole cover, wherein the latch member is rotatably coupled to the latch housing about a second transverse axis parallel to the first transverse axis;

wherein the latch member is configured to rotate about the second transverse axis between an unlocked position and a locked position, wherein in the locked position, the latch extends radially outward relative to the manhole cover, and wherein in the unlocked position, the latch extends radially upward relative to the manhole cover.

7. The latch assembly of claim 6, further comprising a latch spring coaxial to the longitudinal axis, the latch spring configured to be compressed between the latch yoke and a lower surface of the manhole cover when the latch member is in the unlocked position.

8. The latch assembly of claim 6, further comprising a lift ring coupled to the latch yoke opposite the latch member, the lift ring disposed on an opposite side of the manhole cover than the latch member, such that the latch yoke is retained in the latch bore.

9. The latch assembly of claim 8, wherein the latch member is configured to rotate to the unlocked position when the lift ring is raised.

10. The latch assembly of claim 1, further comprising a second yoke arm having a second yoke pin bore coaxial with the first yoke pin bore along the first transverse axis, wherein the latch member is rotatably coupled to the first and second yoke pin bores.

11. A latch assembly for a manhole cover, comprising:

a latch yoke, comprising:

a yoke shaft extending along a longitudinal axis, the yoke shaft configured to be slidingly received through a latch bore of a manhole cover; and a first yoke arm having a first yoke pin bore defining a first transverse axis perpendicular to the longitudinal axis;

a latch member rotatably coupled to the latch yoke about the first transverse axis, the latch member defining a latch configured to engage a catch of a manhole frame; and a latch housing extending from the manhole cover, the latch housing comprising an inner wall configured to interface with the latch member to prevent rotation of the latch member;

wherein the latch member is rotatably coupled to the latch housing about a second transverse axis parallel to the first transverse axis; and wherein the inner wall is positioned between the yoke shaft and the center of the manhole cover.

12. The latch assembly of claim 11, wherein the longitudinal axis intersects the latch member.

13. The latch assembly of claim 11, wherein the latch yoke further comprises a yoke base extending laterally away from the yoke shaft, the yoke base comprising a first base end coupled to the first yoke arm.

14. The latch assembly of claim 11, further comprising a latch spring coaxial to the longitudinal axis, the latch spring configured to be compressed between the latch yoke and a lower surface of the manhole cover.

15. The latch assembly of claim 11, further comprising a lift ring coupled to the latch yoke opposite the latch member, the lift ring disposed on an opposite side of the manhole cover than the latch member, such that the latch yoke is retained in the latch bore.

16. The latch assembly of claim 15, wherein the latch member is configured to rotate to the unlocked position when the lift ring is raised.

17. A latch assembly for a manhole cover, comprising:

a latch yoke, comprising:

a yoke shaft extending along a longitudinal axis, the yoke shaft configured to be slidingly received through a latch bore of a manhole cover; and a first yoke arm having a first yoke pin bore defining a first transverse axis perpendicular to the longitudinal axis;

a latch member rotatably coupled to the latch yoke about the first transverse axis, the latch member defining a latch configured to engage a catch of a manhole frame; and a latch housing extending from the manhole cover, the latch housing comprising a first lateral wall, a second lateral wall, and an inner wall;

wherein the latch member is rotatably coupled to the first lateral wall and the second lateral wall about a second transverse axis parallel to the first transverse axis;

wherein first and second lateral walls extend further from the manhole cover than the inner wall, such that the catch is defined at a distal end of the inner wall between the first and second lateral walls; and wherein the latch member defines a stop opposite the latch, the stop configured to engage a catch defined by the inner wall of the latch housing.

18. The latch assembly of claim 17, wherein the latch of the latch member cooperates with a lug to limit travel of the manhole cover in the direction generally along the longitudinal axis.

19. The latch assembly of claim 17, further comprising a latch spring configured to be compressed between the latch yoke and the manhole cover.

20. A latch assembly for a manhole cover, comprising:

a latch yoke, comprising:

a yoke shaft extending along a longitudinal axis, the yoke shaft configured to be slidingly received through a latch bore of a manhole cover;

a yoke base extending laterally away from the yoke shaft, the yoke base comprising a first base end; and a first yoke arm coupled to the first base end, the first yoke arm having a first yoke pin bore defining a first transverse axis perpendicular to the longitudinal axis;

a latch member rotatably coupled to the latch yoke about the first transverse axis, the latch member defining a latch configured to engage a catch of a manhole frame; and a latch housing extending from the manhole cover, the latch housing comprising an inner wall configured to interface with the latch member to restrict rotation of the latch member;

wherein the latch member is rotatably coupled to the latch housing about a second transverse axis parallel to the first transverse axis; and wherein the inner wall is positioned between the yoke shaft and the center of the manhole cover.

* * * * *